US005510219A

United States Patent [19]

Agata et al.

[11] Patent Number: 5,510,219

[45] Date of Patent: Apr. 23, 1996

[54] TONER FOR ELECTROSTATIC-IMAGE DEVELOPMENT AND PROCESS FOR PRODUCING THE SAME

[75] Inventors: Takeshi Agata; Takashi Imai, both of Minami Ashigara, Japan

[73] Assignee: Fuji Xerox Co., Ltd., Tokyo, Japan

[21] Appl. No.: 325,938

[22] Filed: Oct. 19, 1994

[30] Foreign Application Priority Data

Dec. 8, 1993 [JP] Japan ..... 5-340246

[51] Int. Cl.[6] ..... G03G 9/087

[52] U.S. Cl. ..... 430/106; 430/137

[58] Field of Search ..... 430/106, 109, 430/110, 138, 137

[56] References Cited

U.S. PATENT DOCUMENTS

| | | | |
|---|---|---|---|
| 4,822,707 | 4/1989 | Inoue et al. | 430/106 |
| 5,254,428 | 10/1993 | Ishikawa et al. | 430/138 |
| 5,399,454 | 3/1995 | Imai et al. | 430/138 |

FOREIGN PATENT DOCUMENTS

| | | |
|---|---|---|
| 53-17737 | 2/1978 | Japan . |
| 58-7648 | 1/1983 | Japan . |
| 5-297633 | 11/1993 | Japan . |

*Primary Examiner*—John Goodrow
*Attorney, Agent, or Firm*—Oliff & Berridge

[57] ABSTRACT

A toner for electrostatic-image development comprising a core containing a binder resin and a colorant, and a shell covering said core, wherein the shell is formed by interfacial polymerization of a first reactant in an oily medium with a second reactant in an aqueous medium, and the colorant is a metallic lake pigment whose surface is treated with a coupling agent containing an amino group or a polyamine compound.

20 Claims, No Drawings

TONER FOR ELECTROSTATIC-IMAGE DEVELOPMENT AND PROCESS FOR PRODUCING THE SAME

FIELD OF THE INVENTION

The present invention relates to a toner for use in the development of electrostatic latent images in electrophotography, electrostatic recording, etc. The present invention also relates to a process for producing the toner.

BACKGROUND OF THE INVENTION

The wet process ordinarily employed for toner particle production comprises dispersing or dissolving a pigment and a binder resin into an oily phase and mixing this oily phase with an aqueous phase to obtain fine toner particles. This process, however, has had problems, for example, that since the pigment has poor dispersibility into the oily phase or has a poor affinity of the organic solvent or binder resin with a pigment, colored toner particles having poor pigment dispersion are formed or part of the pigment is present outside the colored fine toner particles.

A method known as an expedient for overcoming these problems comprises treating the surface of pigment particles to improve the dispersibility of the pigment. For example, a technique of surface treatment is disclosed in JP-A-53-17737 (the term "JP-A" as used herein means an "unexamined published Japanese patent application.") and JP-A-58-7648 which comprises treating a pigment in an organic solvent with a silane coupling agent or a titanate coupling agent and then drying and heating the resulting pigment to chemically bond the silane or titanate coupling agent to the pigment surface.

However, the conventionally known technique for the surface treatment of a pigment has had a drawback that since the pigment treated in an organic solvent should be taken out of the organic solvent before being subjected to the subsequent processing, the pigment particles are apt to aggregate to form secondary particles, often resulting in a toner in which the pigment is poorly dispersed. Moreover, in the case of a metallic lake pigment, it is difficult even with the above conventional technique to inhibit the separation of pigment particles from colored fine toner particles. As a result, the toner thus obtained has impaired powder properties, e.g., poor electrostatic properties and reduced preservability, because of the pigment unevenly dispersed in the colored fine toner particles. The present invention has been attained under the circumstances described above.

SUMMARY OF THE INVENTION

An object of the present invention is to provide a toner for electrostatic-image development which is produced by a wet process using a metallic lake pigment and which has good electrostatic properties and is capable of giving high-quality images, by inhibiting the separation of pigment particles from colored fine toner particles.

Another object of the present invention is to provide a process for producing the toner.

As a result of intensive studies made by the present inventors, they have found that the above objects can be accomplished with a method in which in the production of a toner by a wet process using a metallic lake pigment, the surface of the metallic lake pigment is treated with a coupling agent having an amino group or a polyamine compound in an oily medium and shells are then formed by interfacial polymerization. The present invention has been completed based on this finding.

The toner of the present invention for electrostatic-image development comprises toner particles each consisting of a core containing a binder resin for fixing and a colorant and a shell with which the core is covered, the shell being one formed by the interfacial polymerization of a first reactant present in an oily medium with a second reactant present in an aqueous medium, and the colorant in the core being a metallic lake pigment whose surface has been treated with either a coupling agent having an amino group or a polyamine compound.

The process of the present invention for producing the toner for electrostatic-image development comprises: treating a surface of a metallic lake pigment in an oily medium with either a coupling agent having an amino group or a polyamine compound; adding to the oily medium a binder resin for fixing and a first reactant necessary for interfacial polymerization; and dispersing the resulting oily mixture into an aqueous medium containing a second reactant necessary for interfacial polymerization to thereby polymerize the two reactants by interfacial polymerization.

DETAILED DESCRIPTION OF THE INVENTION

In the toner for electrostatic-image development according to the present invention, the cores contain a binder resin as an ingredient for fixing and further contain as a colorant a metallic lake pigment whose surface has been treated with either a coupling agent having an amino group or a polyamine compound. A known binder resin for fixing may be used as the fixing ingredient, but a binder resin soluble in organic solvents is preferred.

Examples of the binder resin include polyesters, polyamides, epoxy resins, amino resins such as polyurea and melamine resins, polyurethanes, poly(vinyl acetate), poly(vinyl chloride), polyvinylpyrrolidone, polyacrylates, polymethacrylates, copolymers of an acrylic or methacrylic ester with acrylic or methacrylic acid or another monomer, styrene polymers, styrene-butadiene copolymers, methyl vinyl ether-maleic anhydride copolymers, coumarone-indene copolymers, and rubbers. Especially preferred of these resins from the standpoints of fixability and color forming property are polyester resins.

The metallic lake pigment used as a colorant is one capable of being subjected to surface treatment with a coupling agent having an amino group or a polyamine compound in an oily medium. For example, known lake pigments may be employed, such as Pigment Yellow 61/61:1, Pigment Yellow 100, Pigment Yellow 169, Pigment Orange 17, Pigment Orange 46, Pigment Red 48.1, Pigment Red 57.1, Pigment Red 60, Pigment Red 58:1, Pigment Red 48.2, Pigment Blue 2, and Pigment Violet 1. The amount of these lake pigments to be used is in the range of from 0.1 to 20% by weight, preferably from 0.5 to 10% by weight, based on the amount of the fixing ingredient.

The coupling agent having an amino group for use in the surface treatment of the metallic lake pigment in an oily medium is preferably an aminosilane coupling agent, an aminotitanate coupling agent, or an aminoaluminum coupling agent.

Examples of the aminosilane coupling agent include γ-aminopropyltrimethoxysilane, γ-aminopropyltriethoxysilane, N-(β -aminoethyl)-γ-aminopropyltrimethoxysilane, γ-(diethylenetriamino)propyltrimethoxysilane, and aminobis(trimethylsilane). Examples of the aminotitanate coupling agent include isopropyl tri(N-aminoethylaminoethyl) titanate, isopropyl tri(p-aminophenyl) titanate, and diaminostearoyl ethylene titanate.

Representative examples of the aminoaluminum coupling agent include those represented by the following structural formula

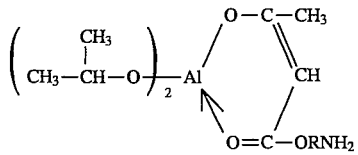

wherein R represents an alkylene group having 1 to 4 carbon atoms.

Examples of the polyamine compound include ethylenediamine, p-xylylenediamine, p-phenylenediamine, triethylenediamine, diethylenetriamine, 1,12-diaminododecane, spermine, pyrazine, and piperazine. Besides these, any known polyamine compound may be used.

The amount of these coupling agents having an amino group or polyamine compounds to be used is in the range of desirably from 0.01 to 10 parts by weight, preferably from 0.1 to 5 parts by weight, per 100 parts by weight of the metallic lake pigment.

On the other hand, the shells in the toner for electrostatic-image development are made of a material formed by the interfacial polymerization of a first reactant present in an oily medium with a second reactant present in an aqueous medium. This shell material preferably comprises at least one resin selected from a polyurea, polyester, polyurethane, polyamide, etc.

Specifically, for the formation of shells by interfacial polymerization, a polyisocyanate compound or a polybasic acid chloride compound may be used as the first reactant and a polyhydroxy compound, a metal salt thereof, or a polyamine may be used as the second reactant.

Examples of the polyisocyanate compound for use as the first reactant include adducts of trimethylolpropane or the like with p-phenylene diisocyanate, 2,4-tolylene diisocyanate, hexamethylene diisocyanate, methylsilyl triisocyanate, xylylene diisocyanate, etc.

Examples of the polybasic acid chloride include adipoyl dichloride, phthaloyl dichloride, and trimellitic acid chloride. However, any known polybasic acid chloride may be used.

The amount of the first reactant to be used is from 0.01 to 10% by weight, preferably from 0.05 to 5% by weight, based on the amount of the fixing ingredient.

Examples of the polyhydroxy compound and metal salt thereof for use as the second reactant include ethylene glycol, 1,3-propanediol, hydroquinone, bisphenol A, and salts of these with sodium, calcium, lithium, etc.

Examples of the polyamine also usable as the second reactant include ethylenediamine, trimethylenediamine, m-phenylenediamine, and piperazine.

Water itself may be used as the second reactant. In the present specification, "a second reactant in an aqueous medium" means not only a second reactant in water but also water itself.

Besides the compounds enumerated above, any known compound of that kind may be used as the second reactant. These compounds may be used alone or in admixture.

The amount of the second reactant to be used is preferably from 1 to 3 mol per mol of the first reactant.

The oily medium is not particularly limited as long as it is capable of dissolving the aminated coupling agent or polyamine compound therein. Examples thereof include ethyl acetate, butyl acetate, and methylene chloride.

The toner of the present invention has an average particle size of 1 to 30 μm, preferably 5 to 20 μm.

A process for producing the toner for electrostatic-image development of the present invention is then explained.

In the first step for producing the toner for electrostatic-image development of this invention, a metallic lake pigment and either a coupling agent containing an amino group or a polyamine compound are added to an organic solvent to treat the surface of the metallic lake pigment. Preferred as the organic solvent is one in which a binder resin as a fixing ingredient is soluble. Examples of such organic solvent include ethyl acetate, butyl acetate, and methylene chloride. The surface treatment of the metallic lake pigment may be accomplished by stirring the mixture of the above ingredients at room temperature. In this case, it is preferred to incorporate a small amount of a binder resin for fixing (e.g., the same amount as in the metallic lake pigment).

The subsequent second step comprises adding a binder resin as a fixing ingredient and a first reactant for shell formation to the oily pigment dispersion obtained above to thereby prepare an oily mixture.

The third step comprises adding the thus-obtained oily mixture to an aqueous medium containing a second reactant for shell formation and emulsifying the oily mixture by a mechanical means, e.g., agitation, to form an O/W (oil in water) emulsion in which the oily mixture is dispersed in the aqueous medium.

For the emulsification of the oily mixture, a protective colloid may be incorporated into the aqueous medium beforehand. A water-soluble polymer may be used as the protective colloid. Although the water-soluble polymer may be suitably selected from anionic polymers, cationic polymers, and amphoteric polymers, preferred examples of the water-soluble polymer are poly(vinyl alcohol), gelatin, and cellulose derivatives. The protective colloid may be used in an amount of 0.1 to 5 wt %, preferably 0.5 to 3 wt % of the aqueous medium.

A surfactant may be further incorporated into the aqueous medium. For this use, a surfactant which does not act on the protective colloid to cause precipitation or coagulation may be suitably selected from anionic or nonionic surfactants. Preferred surfactants include sodium alkyl sulfates (e.g., sodium lauryl sulfate), sodium alkylbenzenesulfonates (e.g., sodium nonylbenzenesulfonate), dioctyl sodium sulfosuccinate, and polyoxyalkylene glycol monoethers (e.g., polyoxyethylene nonylphenol ether). The surfactant may be used in an amount of 0.1 to 5 wt %, preferably 0.5 to 3 wt % of the aqueous medium.

By heating the O/W emulsion thus obtained by dispersing the oily mixture into the aqueous medium, an interfacial polymerization reaction readily takes place on the surface of the droplets of the oily mixture to form shells and at the same time the oily medium is removed.

The interfacial polymerization is conducted by stirring the oily-aqueous medium at a temperature of less than 100° C., preferably 20° to 80° C., for 30 minutes to 20 hours.

If desired and necessary, additives such as an antistatic agent and a fixing aid may be incorporated into the toner for electrostatic-image development of the invention. Further, a fluidizing agent, e.g., silica, titania, or alumina, a cleaning aid, e.g., fine polystyrene particles or fine poly(vinylidene fluoride) particles, or a transfer aid may be added as an external additive.

The toner for electrostatic-image development of the present invention may be used as a one-component developer or two-component developer.

In the present invention, an oily mixture containing a metallic lake pigment whose surface has been treated with a coupling agent containing an amino group or a polyamine compound in an oily medium and further containing a binder resin for fixing and a first reactant is subjected to interfacial polymerization in an aqueous medium containing a second reactant. Thus, shells are formed to obtain a toner. Since the surface of the metallic lake pigment used above has been treated with a coupling agent containing an amino group or a polyamine compound in an oily medium, the metallic lake pigment shows good dispersibility. In addition, the migration of the metallic lake pigment to water is inhibited by the interaction between amino groups and the shells formed by interfacial polymerization. As a result, long-lasting satisfactory electrostatic properties can be imparted to the colored toner obtained.

The present invention will be explained below in more detail by reference to the following Examples, but the invention should not be construed as being limited thereto. In the Examples and Comparative Example, all parts are by weight.

EXAMPLE 1

A mixture of 2 parts of a linear polyester resin ($T_g$, 46° C.; $T_m$, 80° C.; acid value, 27; hydroxyl value, 34.2), 2 parts of Pigment Red 57.1 (Brilliant Carmine 6B), 0.5 parts of Solsperse 24,000 (manufactured by ICI Japan Ltd.; dispersibility improving agent for pigment), and 20 parts of ethyl acetate was treated with a sand mill to obtain a pigment dispersion. To the thus-obtained pigment dispersion was added 0.5 parts of N-(β-aminoethyl)-γ-aminopropyltrimethoxysilane. The resulting mixture was stirred at room temperature for 1 hour to conduct surface treatment of the pigment. Subsequently, 30 parts of the same polyester resin as the above one was dissolved in the mixture. Therein were then dissolved 3 parts of the adduct of 3 mol of xylylene diisocyanate with 1 mol of trimethylolpropane (Takenate D-110N, manufactured by Takeda Chemical Industries, Ltd., Japan) and 0.9 parts of methylsilyl triisocyanate (Orgatics 310, manufactured by Matsumoto Kosho K.K., Japan). Thus, an oily mixture was prepared.

The oily mixture was then added to 120 parts of a 2 wt % aqueous solution of carboxymethyl cellulose (Cellogen SBH, manufactured by Daiichi Yakuhin Kogyo K.K., Japan; dispersing agent for dispersing the oily medium uniformly or stably in the aqueous medium). The resulting mixture was agitated for 2 minutes to obtain an O/W emulsion having an average particle diameter of 0.5 μm.

To the emulsion obtained was added 300 parts of water. This mixture was stirred in a 50° C. thermostatic chamber for 3 hours to thereby simultaneously conduct an interfacial polymerization reaction and the removal of the ethyl acetate. After the aqueous phase was removed from the resulting particles with a centrifugal separator, the particles were dispersed into cleaning water and then separated therefrom, which cleaning treatment was conducted three times. The cleaned particles were freeze-dried to obtain toner particles having an average particle diameter of 5 to 4 μm.

One part of hydrophobic titanium oxide (T805, manufactured by Nippon Aerosil Co., Ltd., Japan) was added to 100 parts of the toner particles obtained above to produce a developer. This developer was set on a copying machine (A-Color, manufactured by Fuji Xerox Co., Ltd.), and copying was performed in each of a summer and a winter environment to measure the density of the copy images obtained. As a result, no change was observed in image density and toner clouding did not occur in the copying operation in the summer environment.

EXAMPLE 2

The same procedure as in Example 1 was carried out except that 0.5 parts of isopropyl tri(N-aminoethylaminoethyl) titanate was used as an aminotitanate coupling agent in place of the aminosilane coupling agent used in Example 1. Thus, toner particles having an average particle diameter of 5 to 4 μm were obtained.

Using the toner particles obtained, the same copying operation as in Example 1 was performed with the copying machine (A-Color, manufactured by Fuji Xerox Co., Ltd.). As a result, satisfactory images could be obtained as in Example 1 regardless of the difference in environment.

EXAMPLE 3

The same procedure as in Example 1 was carried out except that 0.5 parts of acetoaminopropoxyaluminum diisopropylate was used as an aminoaluminum compound coupling agent in place of the aminosilane coupling agent used in Example 1. Thus, toner particles having an average particle diameter of 4 to 5 μm were obtained. Using the toner particles obtained, the same copying operation as in Example 1 was performed with the copying machine (A-Color, manufactured by Fuji Xerox Co., Ltd.). As a result, satisfactory images could be obtained as in Example 1 regardless of the difference in environment.

EXAMPLE 4

The same procedure as in Example 1 was carried out except that 0.5 parts of p-xylylenediamine was used in place of 0.5 parts of N-(β-aminoethyl)-γ-aminopropyltrimethoxysilane. Thus, toner particles having an average particle diameter of 5 to 4 μm were obtained.

One part of hydrophobic titanium oxide (T805, manufactured by Nippon Aerosil Co., Ltd.) was added to 100 parts of the toner particles obtained above to produce a developer. This developer was set on the copying machine (A-Color, manufactured by Fuji Xerox Co., Ltd.), and copying was performed in each of a summer and a winter environment to measure the density of the copy images obtained. As a result, no change was observed in image density and toner clouding did not occur in the copying operation in the summer environment.

EXAMPLE 5

The same procedure as in Example 1 was carried out except that diethylenetriamine was used in place of N-(β-aminoethyl)-γ -aminopropyltrimethoxysilane and that Pigment Yellow 169 was used as a metallic lake compound. Thus, toner particles having an average particle diameter of 5 to 4 μm were obtained.

Using the toner particles obtained, the same copying operation as in Example 1 was performed with the copying machine (A-Color, manufactured by Fuji Xerox Co., Ltd.). As a result, satisfactory images could be obtained as in Example 1 regardless of the difference in environment.

COMPARATIVE EXAMPLE

The same procedure as in Example 1 was carried out except that the aminosilane coupling agent was not used. As a result, however, toner particles were unable to be obtained because no particles were formed.

The present invention produces the following effect. That is, since the present invention has the constitution described above, the toner for electrostatic-image development obtained is inhibited from suffering the separation of metallic lake pigment particles from the toner particles, so that the metallic lake pigment contained is evenly dispersed in the toner particles. Therefore, the toner for electrostatic-image development of the present invention has homogeneous electrostatic properties and is capable of giving images of satisfactory quality.

While the invention has been described in detail and with reference to specific embodiments thereof, it will be apparent to one skilled in the art that various changes and modifications can be made therein without departing from the spirit and scope thereof.

What is claimed is:

1. A toner for electrostatic-image development comprising a core containing a binder resin and a colorant comprising a metallic lake pigment surface treated with a coupling agent containing an amino group or a polyamine compound, and a shell covering said core, wherein said shell is formed by interfacial polymerization of a first shell-forming reactant in an oily medium with a second shell-forming reactant in an aqueous medium.

2. The toner as claimed in claim 1, wherein said coupling agent containing an amino group is an aminosilane coupling agent, an aminotitanate coupling agent or an aminoaluminum coupling agent.

3. The toner as claimed in claim 1, wherein said first reactant is a polyisocyanate compound or a polybasic acid chloride compound.

4. The toner as claimed in claim 1, wherein said second reactant in an aqueous medium is a polyhydroxy compound in water, a metal salt of polyhydroxy compound in water, a polyamine in water, or water.

5. A process for producing a toners for electrostatic-image development comprising a binder resin and a colorant, and a shell covering said core, comprising: treating a surface of a metallic lake pigment in an oily medium with a coupling agent containing an amino group or a polyamine compound; adding to said oily medium a binder resin and a first reactant necessary for interfacial polymerization; and dispersing the resulting oily mixture into an aqueous medium containing a second reactant necessary for interfacial polymerization to thereby polymerize the two reactants by interfacial polymerization.

6. A process for producing a toner for electrostatic-image development, comprising: dissolving or dispersing (a) a coupling agent containing an amino group or a polyamine compound, (b) a binder resin and (c) a colorant in a common solvent for dispersing (a), (b) and (c); adding to the dispersion a first shell-forming reactant for interfacial polymerization; mixing the resulting dispersion containing said first reactant with a second solvent containing a second shell-forming reactant for interfacial polymerization to form an O/W dispersion; and reacting said first reactant with said second reactant to form a shell and removing said common solvent.

7. The toner as claimed in claim 1, wherein said binder resin is selected from the group consisting of polyester, polyamide, epoxy resin, amino resin, polyurethane, poly(vinyl acetate), poly(vinyl chloride), polyvinylpyrrolidone, polyacrylate, polymethacrylate, copolymer of an acrylic ester, copolymer of a methacrylic ester, styrene polymer, styrenebetadiene copolymer, methyl vinyl ether-maleic anhydride copolymer, coumarone-indene copolymer, and rubber.

8. The toner as claimed in claim 7, wherein the amino resin is selected from the group consisting of polyurea resin and melamine resin.

9. The toner as claimed in claim 1, wherein said metallic lake pigment is selected from the group consisting of Pigment Yellow 61/61:1, Pigment Yellow 100, Pigment Yellow 169, Pigment Orange 17, Pigment Orange 46, Pigment Red 48.1, Pigment Red 57.1, Pigment Red 60, Pigment Red 58:1, Pigment Red 48.2, Pigment Blue 2, and Pigment Violet 1.

10. The toner as claimed in claim 2, wherein said aminosilane coupling agent is selected from the group consisting of γ-aminopropyltrimethoxysilane, γ-aminopropyltriethoxysilane, N-(β-aminoethyl)-γ-aminopropyltrimethoxysilane, γ-(diethylenetriamino)propyltrimethoxysilane, and aminobis(trimethylsilane).

11. The toner as claimed in claim 2, wherein said aminotitanate coupling agent is selected from the group consisting of isopropyl tri(N-aminoethylaminoethyl) titanate, isopropyl tri(p-aminophenyl) titanate, and diaminostearoyl ethylene titanate.

12. The toner as claimed in claim 1, wherein said polyamine compound is selected from the group consisting of ethylenediamine, p-xylylenediamine, p-phenylenediamine, triethylenediamine, diethylenetriamine, 1,12-diaminododecane, spermine, pyrazine, and piperazine.

13. The toner as claimed in claim 1, wherein said pigment surface is treated with 0.01 to 10 parts by weight of the amino group or polyamine compound per 100 parts by weight of the metallic lake pigment.

14. The toner as claimed in claim 1, wherein said pigment surface is treated with 0.1 to 5 parts by weight of the amino group or polyamine compound per 100 parts by weight of the metallic lake pigment.

15. The process as claimed in claim 5, wherein a protective colloid is incorporated into said aqueous medium.

16. The process as claimed in claim 15, wherein said protective colloid is incorporated in an amount of 0.1 to 5 wt. % of the aqueous medium.

17. The process as claimed in claim 15, wherein said protective colloid is incorporated in an amount of 0.5 to 3 wt. % of the aqueous medium.

18. The process as claimed in claim 5, wherein a surfactant is incorporated into the aqueous medium.

19. The process as claimed in claim 5, wherein said interfacial polymerization is conducted at a temperature less than 100° C.

20. The process as claimed in claim 5, wherein said interfacial polymerization is conducted at a temperature between 20°–80° C. for a period of 30 minutes to 20 hours.

* * * * *